US009161624B2

(12) United States Patent
Haemmerle

(10) Patent No.: US 9,161,624 B2
(45) Date of Patent: Oct. 20, 2015

(54) RAIL FOR A MOVABLE FURNITURE PART

(71) Applicant: Julius Blum GmbH, Hochst (AT)

(72) Inventor: Juergen Haemmerle, Lustenau (AT)

(73) Assignee: JULIUS BLUM GMBH, Hochst (AT)

( * ) Notice: Subject to any disclaimer, the term of this patent is extended or adjusted under 35 U.S.C. 154(b) by 0 days.

(21) Appl. No.: 13/933,602

(22) Filed: Jul. 2, 2013

(65) Prior Publication Data

US 2013/0293079 A1 Nov. 7, 2013

Related U.S. Application Data

(63) Continuation of application No. PCT/AT2011/000493, filed on Dec. 13, 2011.

(30) Foreign Application Priority Data

Jan. 3, 2011 (AT) ..... 5/2011

(51) Int. Cl.

| | |
|---|---|
| ***A47B 88/00*** | (2006.01) |
| ***A47B 88/04*** | (2006.01) |
| *A47B 95/00* | (2006.01) |

(52) U.S. Cl.

CPC ..... *A47B 88/0422* (2013.01); *A47B 88/0085* (2013.01); *A47B 88/04* (2013.01); *A47B 2088/0092* (2013.01); *A47B 2095/006* (2013.01)

(58) Field of Classification Search

CPC ..... A47B 88/0085; A47B 2088/0088; A47B 2088/0092; A47B 2210/02; A47B 88/00

USPC ..... 312/330.1, 348.1, 348.2, 348.4; 403/DIG. 13, DIG. 11, 65, 68, 71, 72, 403/150, 152, 157, 187; 411/48

See application file for complete search history.

(56) References Cited

U.S. PATENT DOCUMENTS

| | | | | | |
|---|---|---|---|---|---|
| 3,687,512 | A | * | 8/1972 | Alston | 312/348.2 |
| 4,802,716 | A | | 2/1989 | Rock et al. | |
| 4,804,239 | A | * | 2/1989 | Rock et al. | 312/265 |
| 4,872,735 | A | * | 10/1989 | Rock et al. | 312/334.21 |
| 5,076,652 | A | * | 12/1991 | Lautenschlager | 312/330.1 |
| 5,466,061 | A | * | 11/1995 | Lautenschlager | 312/348.2 |

(Continued)

FOREIGN PATENT DOCUMENTS

| | | |
|---|---|---|
| AT | 506 783 | 12/2009 |
| CN | 1568866 | 1/2005 |

(Continued)

OTHER PUBLICATIONS

International Search Report issued Apr. 5, 2012 in International (PCT) Application No. PCT/AT2011/000493.

(Continued)

*Primary Examiner* — Janet M Wilkens

(74) *Attorney, Agent, or Firm* — Wenderoth, Lind & Ponack, L.L.P.

(57) ABSTRACT

A rail for a movable furniture part includes a rail brace (railing strut) and a panel fixing device at an end of the rail brace to fix the rail to a front panel of the movable furniture part. A mounting part of the panel fixing device can be rigidly connected to the front panel. The rail brace is at least partly hollow and is designed in a movable manner relative to the mounting part. The rail brace, which is pushed in the direction of the mounting part, receives and covers the panel fixing device.

22 Claims, 8 Drawing Sheets

(56) References Cited

U.S. PATENT DOCUMENTS

| | | | | |
|---|---|---|---|---|
| 5,525,002 | A * | 6/1996 | Huber | 403/261 |
| 5,611,637 | A * | 3/1997 | Brustle et al. | 403/297 |
| 5,647,711 | A * | 7/1997 | Berger | 411/400 |
| 5,690,405 | A * | 11/1997 | Huber | 312/348.2 |
| 6,120,226 | A * | 9/2000 | Egger et al. | 411/48 |
| 6,224,176 | B1 * | 5/2001 | Suzuki | 312/278 |
| 2004/0222682 | A1 | 11/2004 | Salice | |
| 2011/0163647 | A1 | 7/2011 | Hartl | |
| 2014/0117828 | A1 * | 5/2014 | Gasser | 312/333 |

FOREIGN PATENT DOCUMENTS

| | | |
|---|---|---|
| DE | 85 31 302 | 8/1986 |
| DE | 37 13 283 | 11/1987 |
| DE | 295 07 834 | 8/1995 |
| DE | 295 07 322 | 9/1995 |
| DE | 198 30 740 | 1/2000 |
| DE | 203 00 574 | 7/2004 |
| DE | 10 2009 025 792 | 11/2010 |

OTHER PUBLICATIONS

Austrian Search Report issued Sep. 26, 2011 in Austrian Application No. A 5/2011.

Chinese Search Report issued Nov. 2, 2014 in parallel Chinese Patent Application No. 201180063953.7.

* cited by examiner

RAIL FOR A MOVABLE FURNITURE PART

BACKGROUND OF THE INVENTION

The invention concerns a railing for a movable furniture part, comprising a railing strut and a panel fixing device at one end of the railing strut for fixing the railing to a front panel of the movable furniture part, wherein a mounting portion of the panel fixing device can be fixedly connected to the front panel.

The invention further concerns a movable furniture part with at least one railing of the kind to be described. The invention also concerns an article of furniture comprising a railing of the specified kind.

There are already a large number of railings of the kind noted above, belonging to the state of the art. For example, DE 295 07 834 U1 of Aug. 24, 1995, discloses a railing which at one end of the railing bar has a fixing fitment screwed into the railing bar. That fixing fitment has a conically narrowing fixing head having radially projecting projections which are sharpened in the manner of a cutting edge. Then, mounting of the railing bar to the front panel is effected in such a way that the fixing head which is pre-mounted to the railing bar but which has not yet been entirely screwed as far as the end surface is introduced into the fixing base, more specifically in an inclined position such that the lower inclined surface line of the fixing head bears against the wall of the fixing bore in the front panel. In that position, the fixing head can be pushed completely into the fixing bore as the radially upwardly projecting projection which is sharpened in a knife edge-like configuration is moved downwardly to such an extent that it does not engage the oppositely disposed wall region of the fixing bore. As soon as the fixing head is pushed completely into the fixing bore, the railing bar is then pivoted into the horizontal position, in which case the free end of the fixing head is raised and the sharpened projection penetrates into the wall of the fixing bore and thus provides a positively locking fixing action in the fixing bore. By rotating the railing bar in the screwing-on direction on to the threaded shank of the fixing head the end of the railing bar is screwed on until it bears against the inside flat side of the front panel and a gap which possibly still exists there is caused to disappear (from the preamble to the description of DE 295 07 834 U1).

A further railing is disclosed in AT 506 783 A4 of Dec. 15, 2009. That railing has an incorporated inclination adjustment for the front panel of a drawer. In that arrangement, the railing has a displaceable cover cap to cover over the adjustment and fixing mechanism of the railing strut.

SUMMARY OF THE INVENTION

The object of the invention is to provide an improved railing.

According to the invention that object is attained in that the railing strut is at least partially hollow and is adapted to be displaceable relative to the mounting portion. The railing strut which is displaced in the direction of the mounting portion receives and covers the panel fixing device. In that way, it is possible to achieve an esthetically attractive railing as in that way only the railing strut in itself is visible and all other mounting portions—like for example the panel fixing device—are no longer visible after mounting of the railing has been effected.

It has proven to be particularly advantageous if the mounting portion of the panel fixing device can be fixedly connected to the front panel by a spreading connection. A firm hold for the railing in the front panel can be achieved by a spreading connection.

In a preferred embodiment, the spreading connection can be activated by a movement of the railing strut relative to the mounting portion of the panel fixing device. That can provide that no tool is needed to produce the spreading connection between the railing strut and the front panel.

It can further preferably be provided that the panel fixing device has at least one joint, wherein spreading of the spreading connection can be actuated by pivotal movement of a pivot lever of the joint. That makes it possible to achieve a particularly simple and fast method of fixing the railing to the front panel.

It has been found to be particularly advantageous if the railing has a sleeve for partially receiving the panel fixing device, wherein the sleeve is provided substantially completely in the interior of the railing strut. The use of a sleeve makes it possible to achieve stable contact between the panel fixing device and the railing strut.

It is particularly preferable that the sleeve has an abutment surface for abutment of the sleeve against the front panel. In that way, it is possible to prevent damage to the front panel when fitting the railing.

In that respect, it is proven to be particularly advantageous if the sleeve and the panel fixing device have mutually corresponding latching portions for fixing the sleeve to the panel fixing device. The use of latching portions affords a particularly fast and simple way of mounting the sleeve to the panel fixing device.

In a preferred embodiment, the railing strut and the sleeve have mutually corresponding latching portions for fixing the railing strut to the sleeve. In that way the railing strut can be easily fixed to the sleeve.

It has further proven to be advantageous if the mutually corresponding latching portions of the railing strut and the sleeve can be coupled together and uncoupled from each other. Thus, the railing strut can be released from the sleeve again. That, therefore, permits easy replacement of possibly damaged parts of the railing in a simple procedure.

It has proven to be advantageous if the railing strut is in one piece. The use of a one-piece railing strut makes it possible to avoid long mounting times for the railing strut itself.

Further, the railing preferably has a rear wall fixing device at the other end of the railing strut for fixing the railing to a rear wall of the movable furniture part. The rear wall fixing device is provided substantially completely at the side of the railing (that is, towards the internal space of the movable furniture part), and corresponds to an end face portion of the rear wall.

In specific terms, a movable furniture part can have at least one railing. Advantageously, the movable furniture part has two railings.

In addition, an article of furniture comprising a furniture carcass and at least one movable furniture part. Preferably, in that case, the movable furniture part is in the form of a drawer.

BRIEF DESCRIPTION OF THE DRAWINGS

Further details and advantages of the present invention are described more fully hereinafter by means of the specific description with reference to the embodiments illustrated in the drawings, in which.

DETAILED DESCRIPTION OF THE INVENTION

Figure 1:
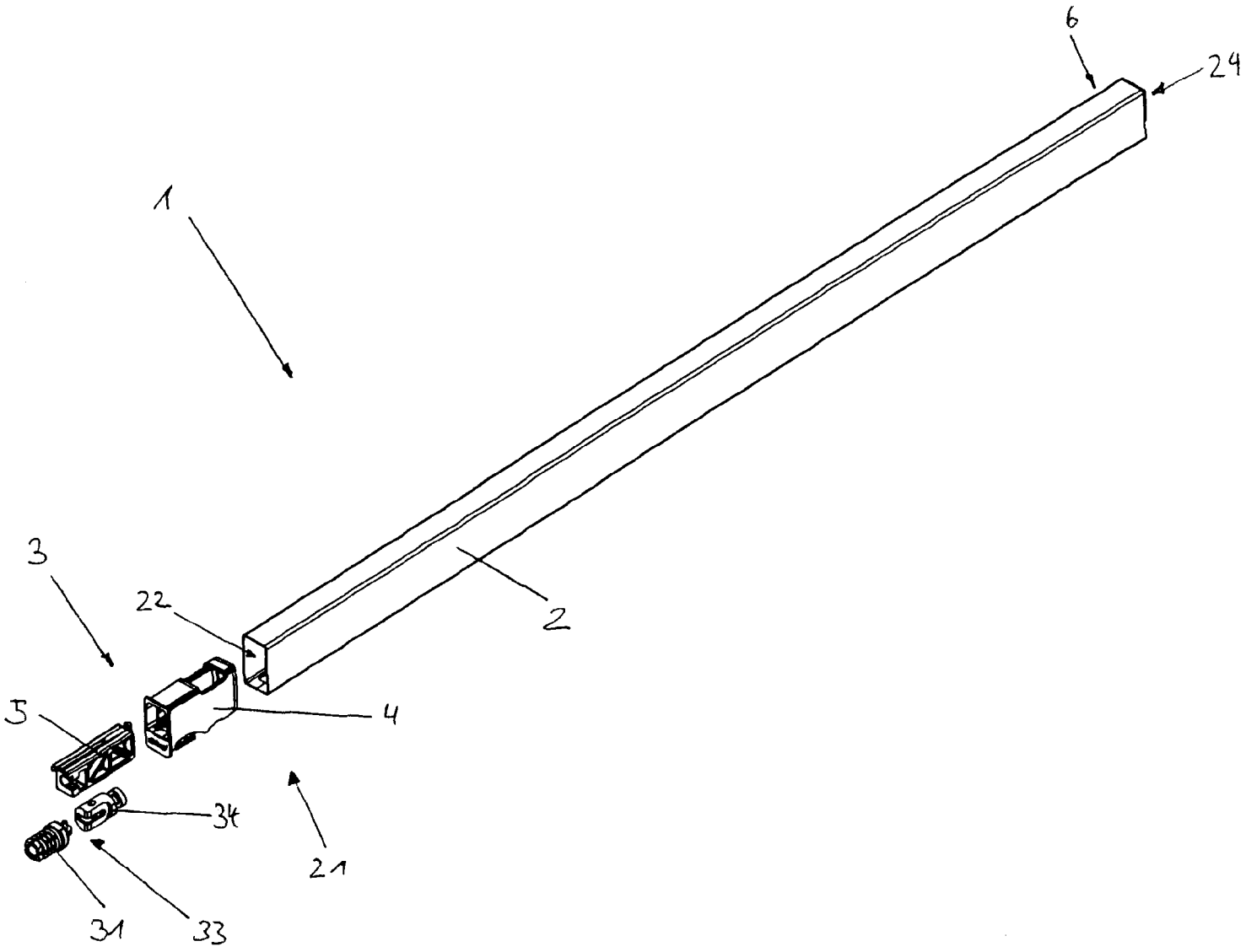
FIG. 1 shows an exploded perspective view of a railing for a moved furniture part.
Figure 3:
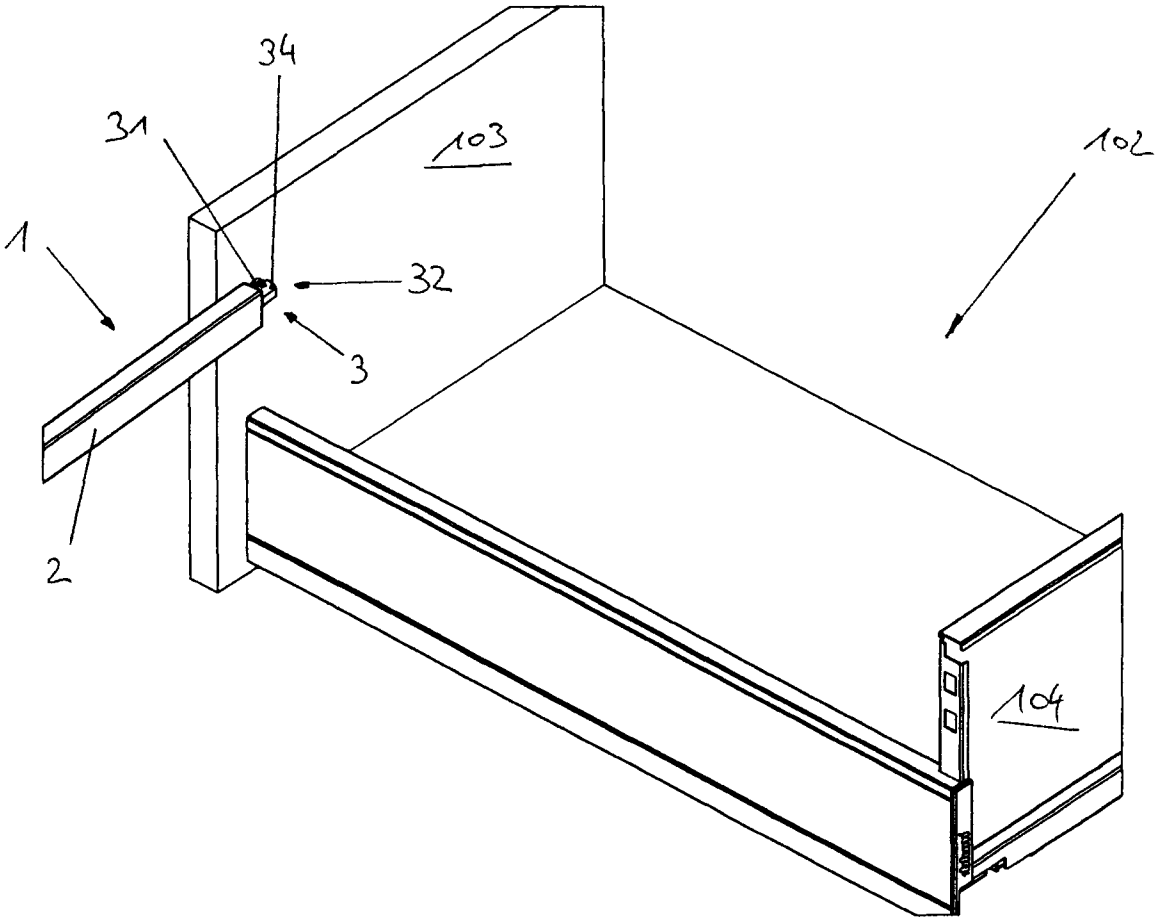
FIG. 3 shows a perspective of a drawer with a railing which has not been fixed.
Figure 4:
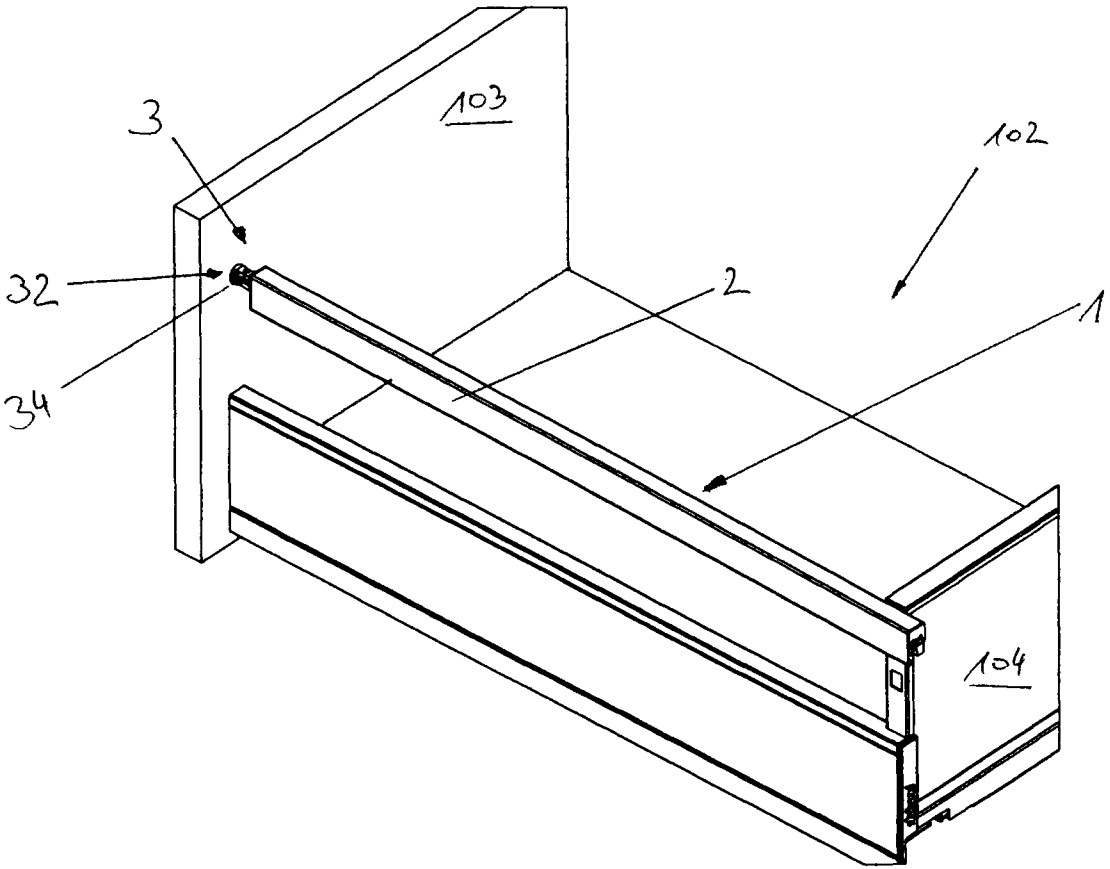
FIG. 4 shows a perspective view of a drawer with a railing which has been partially fixed.
Figure 5:
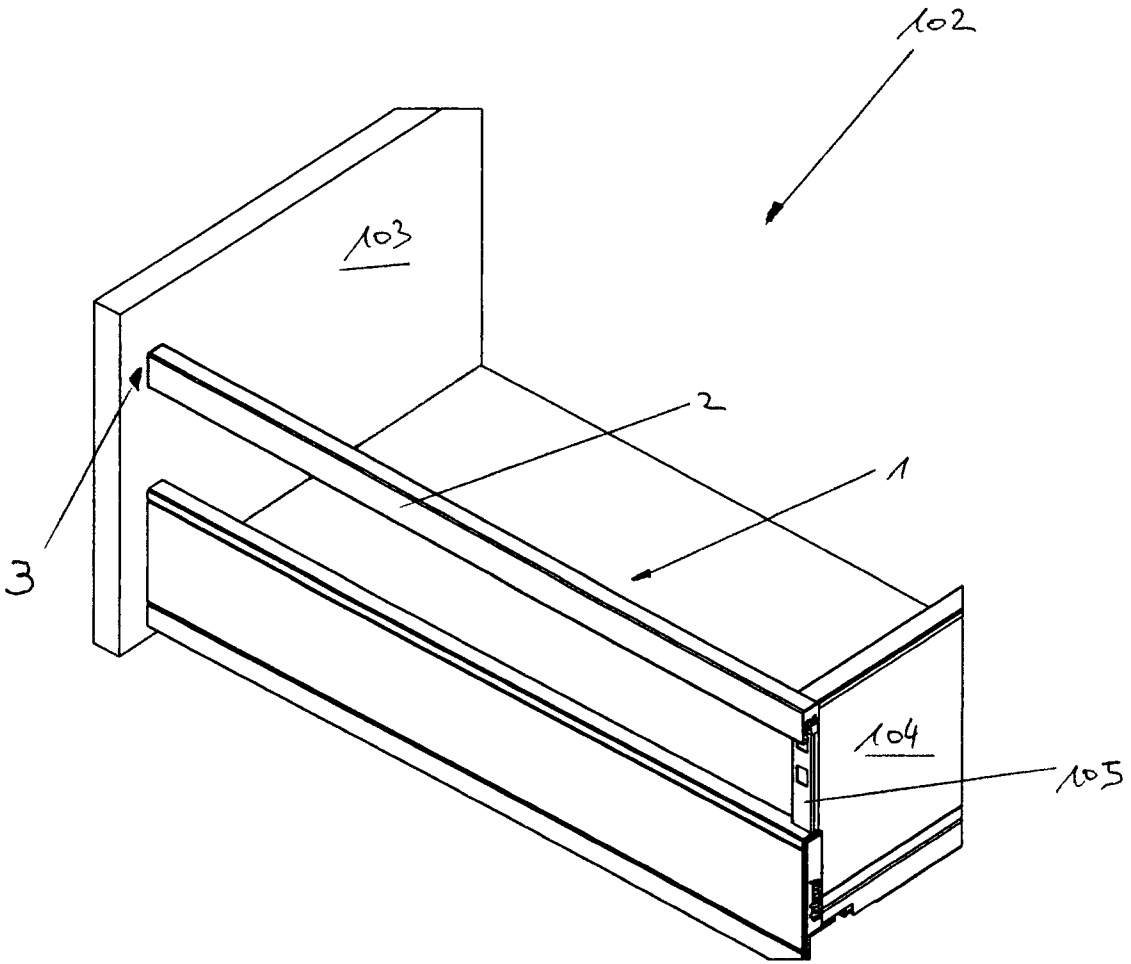
FIG. 5 shows a perspective view of a drawer with a railing which has been fixed.

FIG. 1 shows an exploded perspective view of a railing 1 for a movable furniture part 102 (not shown) (see FIGS. 3 through 5).

Figure 2:
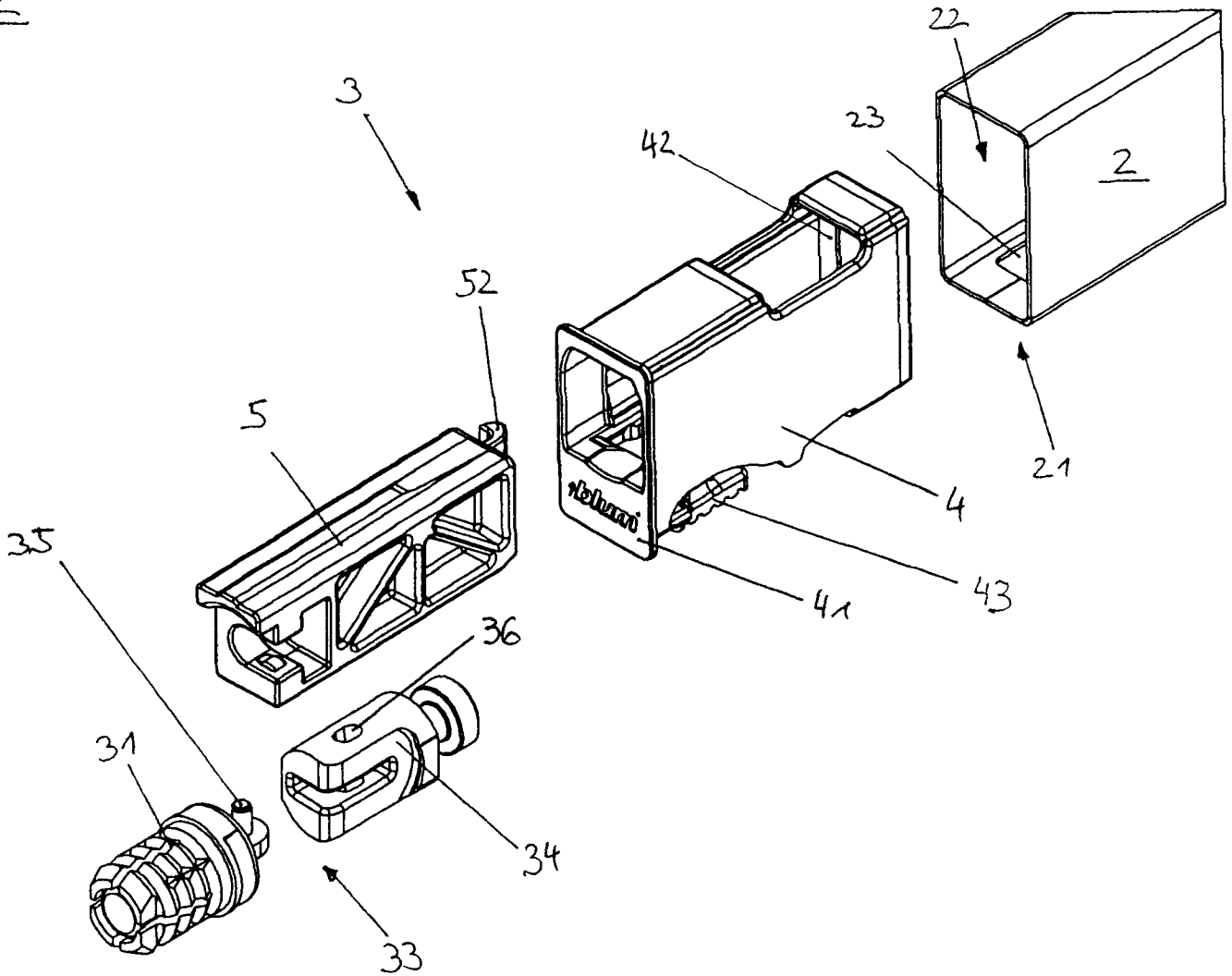
FIG. 2 shows a detail view of FIG. 1.

The railing 1 has a railing strut 2 and a panel fixing device 3 at a first end 21 of the railing strut 2 for fixing the railing 1 to a front panel 103 (not shown) of the movable furniture part 102. For that purpose, the panel fixing device 3 has a mounting portion 31 which can be connected to the front panel 103. In this arrangement, provided on the mounting portion 31 is a joint spindle 35 (FIG. 2) which corresponds to a through opening 36 in the joint lever 34. The mounting portion 31 and the joint lever 34 in that case form the joint 33. The mounting portion 31 is spread or released by a pivotal movement of the joint lever 34 relative to the mounting portion 31, whereby a connection with the front panel 103 can be made or released respectively. Such spreading connections are already known from the state of the art and are no longer novel (see in that respect for example EP 0 698 357 A1 of Aug. 21, 1995).

In the assembled condition, the joint lever 34 of the panel fixing device is inserted in the guide portion 5. The guide portion 5, in turn, has a latching portion 52 corresponding to a (first) latching portion 42 of the sleeve 4. The sleeve 4 in turn also has a further (second) latching portion 43 corresponding to a latching portion 23 of the railing strut 2—in this case in the form of a through opening.

In this preferred embodiment, the railing strut 2 has a substantially completely hollow interior 22 and can thus accommodate in its interior the sleeve 4, the guide portion 5 and the joint lever 34 and also in part the mounting portion 31 (see in this respect FIG. 5).

At one end, the sleeve 4 has an abutment surface 41 provided for abutment against the front panel 103 to prevent damage to the railing strut 2 or the front panel 103 in the assembly procedure.

In this case, the corresponding latching portions 43 and 23 of the railing strut 2 and the sleeve 4 are adapted to be coupled together and uncoupled from each other. Thus the railing strut 2 can also be subsequently removed again from the sleeve 4 or the panel fixing device 3 accommodated in the sleeve 4.

FIG. 3 shows a perspective view of a drawer 102 which has, inter alia, a front panel 103 and a rear wall 104. The mounting portion 31 of the railing 1 is already inserted in the front panel 103, but not yet fixed. Fixing is effected by way of a spreading connection 32 whereby the mounting portion 31 of the panel fixing device 3 can be fixedly connected to the front panel 103. Spreading of the spreading connection 32 is effected by rotating the panel fixing device 3 relative to the front panel 103. The panel fixing device 3 is already partially adapted to be pre-fitted in the railing strut 2. As a result, the spreading connection 32 can be activated by a movement of the railing strut 2 relative to the mounting portion 31 of the panel fixing device 3. FIG. 3 shows only one railing 1, but in practice it is provided that a drawer 102 has two such railings 1.

It will be appreciated that the railing 1 could also be fixed to a front panel 103 in a different way, like for example by screwing in, pressing in, insertion or for example by means of an expander dowel or the like.

FIG. 4 shows the drawer 102 with the railing 1 already partially fitted. In this view, the spreading connection 32 is already activated as the joint lever 34 of the panel fixing device 3 spreads open the mounting portion 31 by way of the joint spindle 35 of the mounting portion 31, and has thus fixedly anchored the mounting portion 31 in the front panel 103. At that time, the panel fixing device 3 is still partially visible, the procedure for mounting the railing 1 is not yet concluded.

As is clearly visible from FIG. 4 in this case, the railing strut 2 of the railing 1 is in one piece. It will be appreciated that equally it could comprise a plurality of parts.

Spreading of the spreading connection 32 was achieved by pivotal movement of the pivot lever 34 of the joint 33 of the panel fixing device 3. It will be appreciated that it is also possible to envisage that a spreading connection 32 can also be implemented in a different way, like for example by rotation of the railing strut 2 about its longitudinal axis, as is also already known from the state of the art.

FIG. 5 shows a perspective view of a drawer 102, in which the railing 1 is completely fitted in place. Because the railing strut 2 is at least partially hollow and is adapted to be displaceable relative to the mounting portion 31 (not shown), the railing strut 2 can be displaced in the direction of the mounting portion 31 and in that case completely covers the panel fixing device 3. Thus, as shown in FIG. 5, the railing strut 2 together with the front panel 103 completely enclose the panel fixing device 3 (panel fixing device 3 is not visible). This, therefore, provides an esthetically attractive railing 1, in which there is no need for an additional cover for the panel fixing device 3 as the railing strut 2 accommodates the panel fixing device 3 in itself.

Figure 6A:
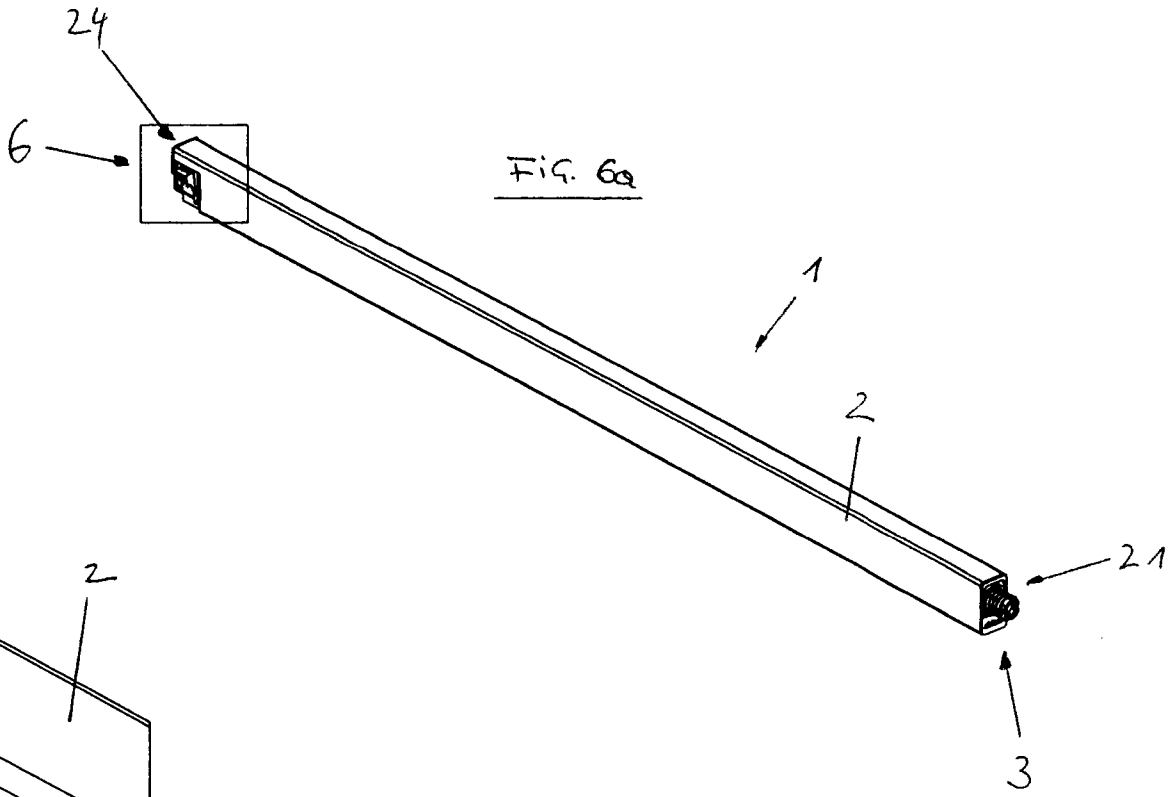
FIG. 6*a* shows a perspective view of a railing.
Figure 6B:
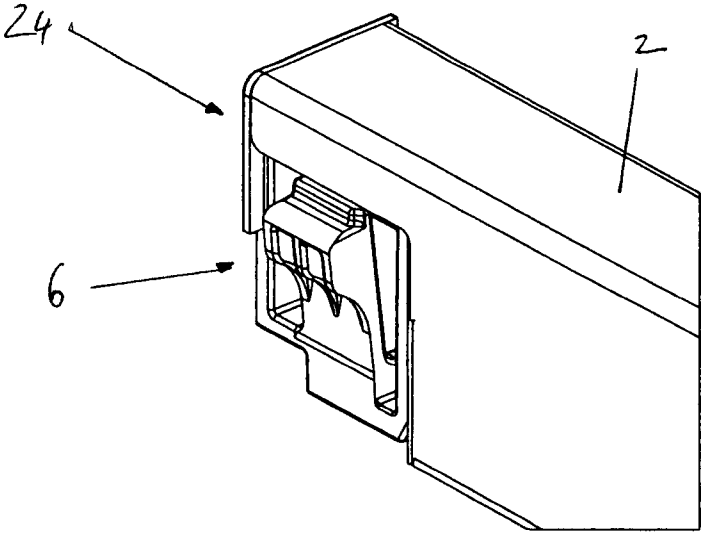
FIG. 6*b* shows a detail view of FIG. 6*a*.
Figure 7B:
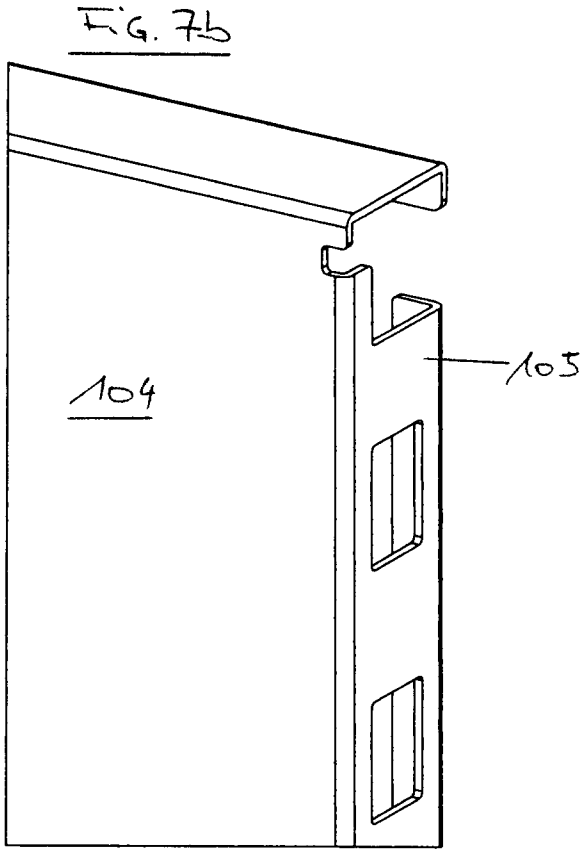
FIG. 7*b* shows a detail view of FIG. 7*a*.
Figure 7A:
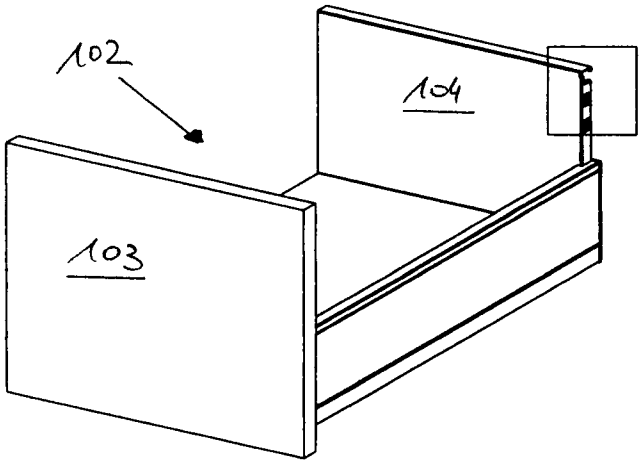
FIG. 7*a* shows a perspective view of a drawer without railing.

Disposed at the second end 24 of the railing 1, that is towards the rear wall 104, is a rear wall fixing device 6 as shown in FIG. 6*a*. In this case, the rear wall fixing device 6 is provided substantially completely at the side of the railing 1, that is towards the internal space of the movable furniture part 102, and in that case corresponds to an end face portion 105 of the rear wall 104 (see FIGS. 7*a* and 7*b*). After the railing strut 2 has been pushed over the panel fixing device 3 the railing strut 2 can be clipped on to the end face portion 105 of the rear wall 104 by the rear wall fixing device 6. It is possible in that way to achieve rapid mounting of the railing 1.

Figure 8:
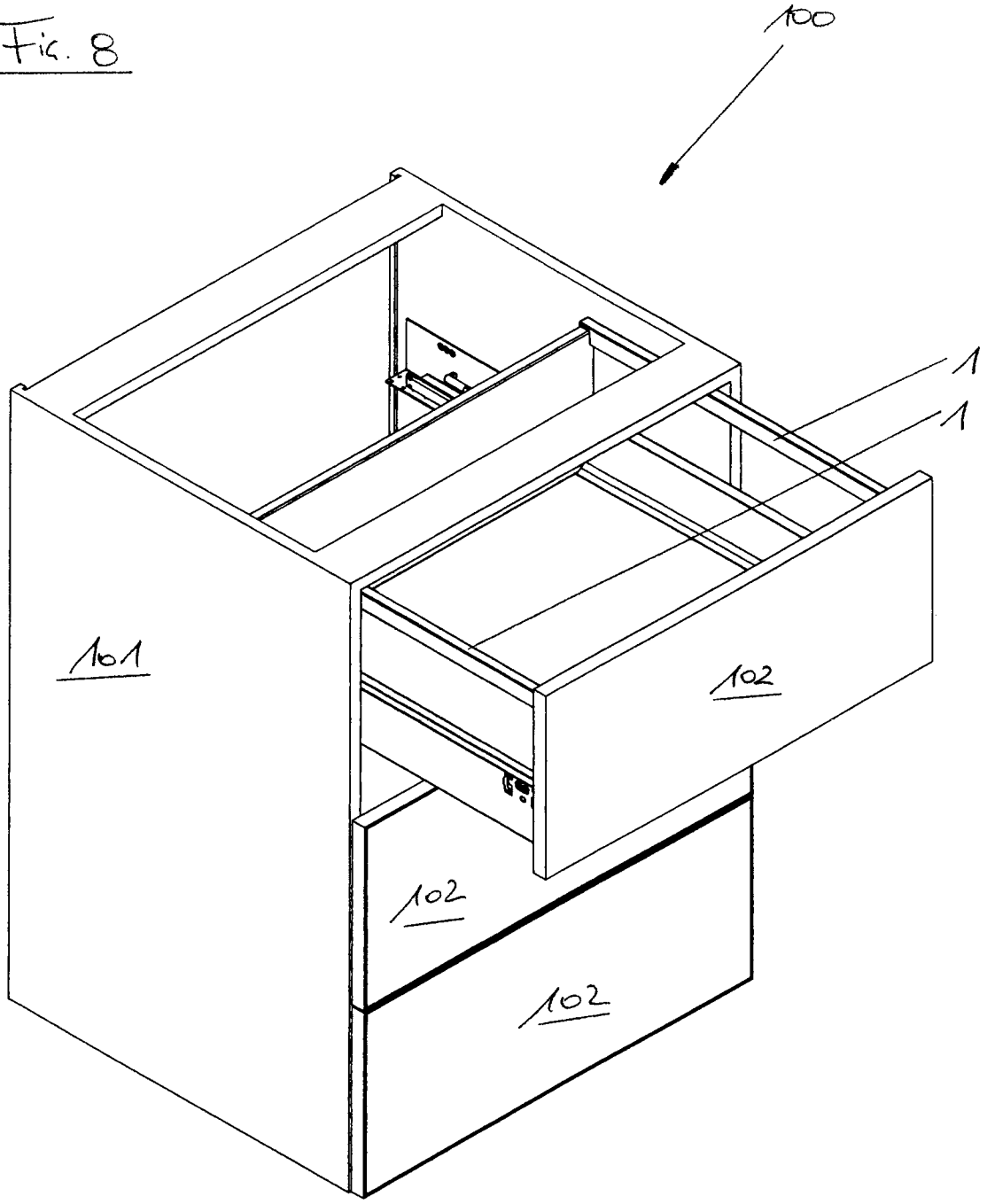
FIG. 8 shows a perspective view of an article of furniture comprising a furniture carcass and drawers.

FIG. 8 shows an article of furniture 100 comprising a furniture carcass 101 and movable furniture parts 102 which are arranged therein and which are in the form of drawers. The drawers 102 each have two railings 1.

The invention claimed is:

1. A railing for a movable furniture part, comprising:

a railing strut;

a panel fixing device at an end of said railing strut for fixing said railing strut to a front panel of the movable furniture part, said panel fixing device including a mounting portion to be connected to the front panel; and a sleeve for partially receiving said panel fixing device, said sleeve being arranged substantially completely in an interior of said railing strut;

wherein said railing strut is at least partially hollow and is configured to be displaceable relative to said mounting portion to receive and cover said panel fixing device; and wherein said railing strut and said sleeve have mutually corresponding latching portions for fixing said sleeve to said railing strut.

2. The railing according to claim 1, wherein said railing strut has a substantially rectangular cross section.

3. The railing according to claim 1, wherein said mounting portion of said panel fixing device has a spreading connection for fixedly connecting said mounting portion to the front panel.

4. The railing according to claim 3, wherein said spreading connection is configured to be activated by a movement of said railing strut relative to said mounting portion of said panel fixing device.

5. The railing according to claim 1, wherein said panel fixing device has at least one joint configured such that spreading of a spreading connection of said mounting portion is actuated by pivotal movement of a pivot lever of said joint.

6. The railing according to claim 1, wherein said sleeve has an abutment surface for abutment of said sleeve against the front panel.

7. The railing according to claim 1, wherein said sleeve and said panel fixing device have mutually corresponding latching portions for fixing said sleeve to said panel fixing device.

8. The railing according to claim 1, wherein said mutually corresponding latching portions of said railing strut and said sleeve are configured to be coupled together and uncoupled from each other.

9. A movable furniture part comprising said railing according to claim 1.

10. The movable furniture part according to claim 9, further comprising a rear wall, said railing including a rear wall fixing device at a second end of said railing strut for fixing said railing to said rear wall, wherein said rear wall fixing device is arranged substantially completely at a side of said railing, said side being towards an internal space of said movable furniture part, and said side corresponding to an end face portion of said rear wall.

11. An article of furniture comprising:

a furniture carcass; and at least one movable furniture part corresponding to said movable furniture part according to claim 10.

12. A railing for a movable furniture part, comprising:

a railing strut; and a panel fixing device at an end of said railing strut for fixing said railing strut to a front panel of the movable furniture part, said panel fixing device including a mounting portion to be connected to the front panel;

wherein said railing strut is at least partially hollow and is configured to be displaceable relative to said mounting portion to receive and cover said panel fixing device; and wherein said panel fixing device has a joint configured such that spreading of a spreading connection of said mounting portion is actuated by pivotal movement of a pivot lever of said joint.

13. The railing according to claim 12, wherein said railing strut has a substantially rectangular cross section.

14. A movable furniture part comprising said railing according to claim 12.

15. The movable furniture part according to claim 14, further comprising a rear wall, said railing including a rear wall fixing device at a second end of said railing strut for fixing said railing to said rear wall, wherein said rear wall fixing device is arranged substantially completely at a side of said railing, said side being towards an internal space of said movable furniture part, and said side corresponding to an end face portion of said rear wall.

16. An article of furniture comprising:

a furniture carcass; and at least one movable furniture part corresponding to said movable furniture part according to claim 15.

17. A railing for a movable furniture part, comprising:

a railing strut; and a panel fixing device at an end of said railing strut for fixing said railing strut to a front panel of the movable furniture part, said panel fixing device including a mounting portion pre-mounted to said railing strut to be connected to the front panel;

wherein said railing strut is at least partially hollow and is configured to be displaceable relative to said mounting portion to receive and cover said panel fixing device; and wherein said panel fixing device has a joint configured such that spreading of a spreading connection of said mounting portion is actuated by pivotal movement of a pivot lever of said joint.

18. The railing according to claim 17, wherein said railing strut has a substantially rectangular cross section.

19. A movable furniture part comprising said railing according to claim 17.

20. The movable furniture part according to claim 19, further comprising a rear wall, said railing including a rear wall fixing device at a second end of said railing strut for fixing said railing to said rear wall, wherein said rear wall fixing device is arranged substantially completely at a side of said railing, said side being towards an internal space of said movable furniture part, and said side corresponding to an end face portion of said rear wall.

21. An article of furniture comprising:

a furniture carcass; and at least one movable furniture part corresponding to said movable furniture part according to claim 20.

22. The railing according to claim 17, wherein said railing strut has a one-piece construction, said railing strut and said panel fixing device being configured such that said panel fixing device is entirely enclosed within said one-piece railing strut and the front panel after mounting.

* * * * *